United States Patent [19]

Bauer et al.

[11] 4,351,174

[45] Sep. 28, 1982

[54] METHOD OF PRODUCING A PROFILE STRIP

[75] Inventors: Herbert Bauer, Bad-Liebenzell; Guenter Weik, Birkenfeld, both of Fed. Rep. of Germany

[73] Assignee: INOVAN - Stroebe G.m.b.H. and Co. KG, Birkenfeld, Fed. Rep. of Germany

[21] Appl. No.: 204,197

[22] Filed: Nov. 5, 1980

[30] Foreign Application Priority Data

Nov. 5, 1979 [DE] Fed. Rep. of Germany ..... 2944613

[51] Int. Cl.[3] ..... B21D 5/00

[52] U.S. Cl. ..... 72/47; 72/339; 29/874

[58] Field of Search ..... 29/874, 882, 885; 72/47, 338, 339, 378, 379; 113/116 HA; 228/142

[56] References Cited

U.S. PATENT DOCUMENTS 1,900,256 3/1933 Payette ..... 29/874 X 3,911,554 10/1975 Ford ..... 228/142 X

FOREIGN PATENT DOCUMENTS 234238 1/1945 Switzerland ..... 29/874

*Primary Examiner*—Ervin M. Combs

*Attorney, Agent, or Firm*—Klaus J. Bach

[57] ABSTRACT

A method of forming a metal strip having a raised side uniformly plated with a layer of a different metal or metal alloy, preferably a precious metal, wherein the plating metal layer is applied to the flat strip and thereafter the strip is folded lengthwise to raise the plated side of the strip in order to obtain the desired profile. The method allows to apply the plating layer on a flat surface which can be easily done by known processes, the strip being bent together with the layer to form said raised uniformly plated side.

6 Claims, 6 Drawing Figures

METHOD OF PRODUCING A PROFILE STRIP

BACKGROUND OF THE INVENTION

1. Field of the Invention

The invention relates to a method of producing a profile strip having at one side a raised center area which is at least partially plated with a layer of a metal or a metal alloy, preferably a precious metal or metal alloy.

2. Description of the Prior Art

Such profile strips or wires are used, for example, in the manufacture of contact members wherein the plated sides of the strips become the contacting sides of contact members. The plating layer consists of precious metal or metal alloys to provide for good current conductivity and a high corrosion resistance. The pretreated contact strip is then usually welded onto a flat carrier member. For good support it should, consequently, have a flat underside or it might have projections extending lengthwise on the strip underside which facilitate welding the strip to such carrier member.

The precious metal layer has to extend over a relatively large area on the raised side of such a profile strip in order to protect the specific contact area, which is about in the center of the profile strip, safely from corrosion, to prevent flaking of the layer at the edges by corrosion and to provide for a relatively wide contact area since the position of the opposite contact is not always properly adjusted. To provide a plating layer only at the predetermined contact area is not sufficient. The same is true, of course, if the contact area is formed not in the center of the contact strip but at its sides.

Such profile strips are usually manufactured by rolling the strip to its desired shape. Precious metal is then selectively deposited on the raised side of the strip. Usually, the precious metal is applied by electroplating, by vapor deposition or by another deposition method. In any case, however, and particularly when electroplated, the deposited layer, that is the precious metal layer, has its greatest thickness in the center of the raised area of the profile strip, that is in cross-section, the layer is sickle-shaped. The metal layer thickness in the center may very well be twice of that at the edges. Since, however, the thickness necessary at the edges would usually be sufficient also for the center contact area, precious metal is deposited in unnecessarily large amounts; that is, it is wasted. Nevertheless, it is difficult to provide by electroplating but also by vapor deposition layers which have the necessary thickness. Usually, the thickness necessary at the edges of the layer is not achieved. It is also disadvantageous that no metal alloys can be deposited by the methods known in the art.

It is also known to first completely plate the metal strips and then to scrape off the unnecessary material to give the strip and the layer thereon the desired shape. This method however is wasteful and very expensive, and consequently, it is usually uneconomical.

It is accordingly desirable to provide a method of producing plated profile strips wherein only the necessary amount of plating material is deposited and the plating material layer has an even thickness over its full width and wherein alloys can be used as plating materials. Also, manufacture of such plated strips should be simple and inexpensive.

SUMMARY OF THE INVENTION

With the method according to the invention, a metal strip having one side raised and a layer of a different metal, preferably a precious metal or metal alloy, disposed on the raised side is made by depositing the layer of different metal first on a flat metal strip and then folding the flat metal strip along its longitudinal axis such that the side with said layer is curved outwardly and the strip cross-section assumes the desired profile.

The profile strip is no longer formed into its final shape before it is plated and no metal is scraped off after plating to obtain the desired shape; rather, the desired metal layer is applied to one side of a flat strip in a known manner. This way the metal layer may be evenly applied over the full width and it may be applied easily and in any desired thickness by any of the known depositing methods. Only after deposition of the layer the still flat strip is folded along its longitudinal axis in such a way that the desired strip profile is obtained. The strip can be folded in a continuous manner by rolling or in a discontinuous manner by stamping. Care must be taken, however, that, in the process of rolling, the strip is not stretched excessively, at least not at its plate side so that the thickness of the metal layer remains at the desired value. Depending on the thickness of the strip it is therefore desirable to use more than one folding or operating step. The number of steps however depends also on the kind of material of which the strip consists.

In any case, the end result is a profile strip whose raised side has applied thereto a uniform layer of a metal different from the metal of the strip. Such a profile strip is less expensive than corresponding metal strips made by prior art methods since only the necessary amount of the precious plating metal is consumed. It is further to be noted that the manufacture of the metal strip is very economical because a simple folding process may be used and any precious metal or metal alloy may be used for plating the base metal strip.

The metal strip is normally flat at its underside so that it is thickest at its center. To facilitate forming of the metal strip to the desired shape, the sides of the flat base metal band may be tapered. It is also possible to provide a profile on the underside of the metal strip.

BRIEF DESCRIPTION OF THE DRAWINGS

The figures show schematically various phases of the process of manufacturing a profile metal strip according to the method of the invention, specifically.

DESCRIPTION OF THE PREFERRED METHOD

Figure 1:
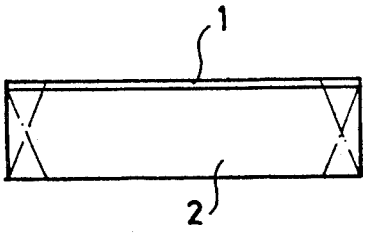
FIG. 1 shows, in cross-section, the plated base metal band from which the profile strip is formed.
Figure 2:
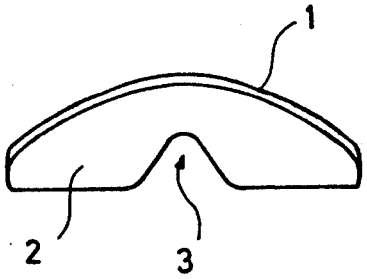
FIG. 2 shows the metal strip after the first processing step.
Figure 3:
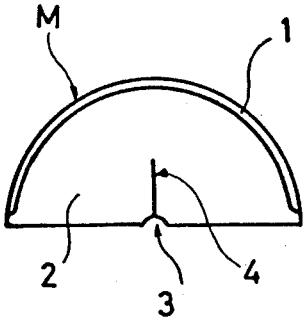
FIG. 3 shows the metal strip after another intermediate processing step.

As the starting material for the manufacture of a profile strip, a metal band 2 of rectangular cross-section is used having a layer 1 of another metal or metal alloy deposited on one of its flat sides. The metal band as shown in FIG. 1 is then formed, for example by rolling, to have the plated side carrying the metal layer 1 arched and to have a central groove extending along its opposite side as shown in FIG. 2. Provision of the central groove 3 greatly facilitates further forming of the strip and permits to provide the desired curved shape without damaging the strip as the following step resides simply in further folding the strip to close the groove 3 and provide a relatively large curvature on the plated side of the strip as shown in FIG. 3. The sides of the groove are seen in FIG. 3 to be forced together so that they are recognizable only as a fold line 4. The metal layer 1 now completely covers the raised portion of the metal strip with a coat M of uniform thickness. In a final forming step the strip 2 may obtain a shape as shown in FIGS. 4*a, b* or *c*.

Figure 4A:
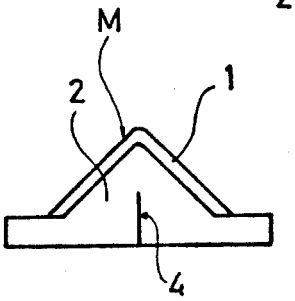
FIGS. 4*a, b,* and *c* show finished profile strips in cross-section.

As shown in FIG. 4*a*, the raised plated side is angled and the underside of the strip 2 is flat.

Figure 4B:
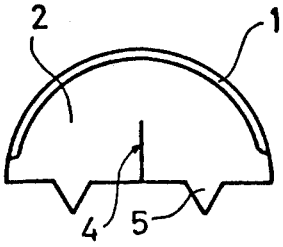

As shown in FIG. 4*b*, the raised plated side is evenly curved and there are projections 5 formed at the underside of the strip, which projections facilitate the welding of the strip onto a base member.

Figure 4C:
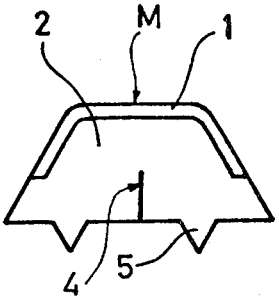

As shown in FIG. 4*c*, the raised plated side is trapezoidal in cross-section and the underside of the strip is also provided with projections 5.

I claim as my invention:

1. A method of forming a metal strip for electrical contact members having a raised side uniformly plated with a layer of at least one metal different from the metal of which said strip consists, said method comprising the steps of: plating a flat metal strip on one of its flat sides with a uniform layer of at least one other metal; forming, in a first forming step, a central groove into said metal strip such that said groove extends lengthwise of said metal strip along its underside opposite said plated side and slightly bending said metal strip such that the plated side is slightly curved; and, in a second forming step, folding the flat metal strip together, lengthwise, with said layer on the outer side so as to close said groove and raise the plated side thereby obtaining the desired outside profile on the outside strip surface carrying said layer.

2. A method as recited in claim 1, wherein a metal alloy is deposited on said metal strip to form said layer.

3. A method as recited in claim 1 or 2, wherein the layer deposited on said metal strip consists of at least one precious metal.

4. A method as recited in claim 1, wherein the sides of said metal strip are tapered.

5. A method as recited in claim 1, wherein said folding step is performed by rolling said strip.

6. A method as recited in claim 1, wherein said folding step is performed by stamping.

* * * * *